US008193998B2

(12) United States Patent
Puente Baliarda et al.

(10) Patent No.: US 8,193,998 B2
(45) Date of Patent: Jun. 5, 2012

(54) ANTENNA CONTACTING ASSEMBLY

(75) Inventors: Carles Puente Baliarda, Barcelona (ES); Eloy Hinojo, Barcelona (ES)

(73) Assignee: Fractus, S.A., Barcelona (ES)

( * ) Notice: Subject to any disclaimer, the term of this patent is extended or adjusted under 35 U.S.C. 154(b) by 728 days.

(21) Appl. No.: 11/886,980

(22) PCT Filed: Apr. 12, 2006

(86) PCT No.: PCT/EP2006/061564

§ 371 (c)(1),
(2), (4) Date: Mar. 13, 2009

(87) PCT Pub. No.: WO2007/098810

PCT Pub. Date: Sep. 7, 2007

(65) Prior Publication Data

US 2009/0213029 A1 Aug. 27, 2009

Related U.S. Application Data

(60) Provisional application No. 60/678,571, filed on May 6, 2005.

(30) Foreign Application Priority Data

Apr. 14, 2005 (EP) ..... 05102942

(51) Int. Cl.
*H01Q 1/50* (2006.01)

(52) U.S. Cl. ..... 343/906; 343/702

(58) Field of Classification Search ..... 343/700 MS, 343/702, 906; 439/66, 862
See application file for complete search history.

(56) References Cited

U.S. PATENT DOCUMENTS

| | | | | |
|---|---|---|---|---|
| 4,839,660 | A | 6/1989 | Hadzoglou | |
| 5,092,783 | A * | 3/1992 | Suarez et al. | 439/71 |
| 5,462,443 | A | 10/1995 | Kurbjuhn et al. | |
| 5,936,583 | A | 8/1999 | Sekine | |
| 6,031,499 | A | 2/2000 | Dichter | |
| 6,039,583 | A | 3/2000 | Korsunsky | |
| 6,157,348 | A | 12/2000 | Openlander | |
| 6,215,446 | B1 | 4/2001 | Sullivan | |
| 6,423,915 | B1 * | 7/2002 | Winter | 200/292 |

(Continued)

FOREIGN PATENT DOCUMENTS

DE 20306921 9/2003

(Continued)

OTHER PUBLICATIONS

Jaggard , D. L. Rebuttal expert report of Dr. Dwight L. Jaggard (redacted version). Fractus. Feb. 16, 2011.

(Continued)

*Primary Examiner* — Tan Ho
(74) *Attorney, Agent, or Firm* — Winstead PC

(57) ABSTRACT

This invention refers to an antenna contacting assembly which allows electrical connection of an antenna element to the RF module of a wireless device when very little space is available on the side of the PCB underneath the antenna element. The antenna contacting assembly provides electrical contact between a first conducting surface and a second conducting surface by engaging in traction mode said first conducting surface with said second conducting surface. Further the invention refers to an antenna system provided with such antenna contacting assembly and the corresponding wireless device with an antenna system provided with such antenna contacting assembly.

24 Claims, 12 Drawing Sheets

U.S. PATENT DOCUMENTS

| | | | | |
|---|---|---|---|---|
| 6,486,837 | B2 | 11/2002 | Spiegel | |
| 6,621,455 | B2 | 9/2003 | Wang | |
| 6,930,644 | B2 | 8/2005 | Konishi | |
| 6,991,472 | B2 * | 1/2006 | Du et al. | 439/66 |
| 7,160,139 | B2 | 1/2007 | Biermann | |
| 2002/0089456 | A1 | 7/2002 | Hamada | |
| 2003/0071756 | A1 | 4/2003 | Bolin et al. | |
| 2003/0193438 | A1 | 10/2003 | Yoon | |
| 2004/0174310 | A1 | 9/2004 | Silva | |
| 2005/0090158 | A1 | 4/2005 | Silva | |
| 2005/0128152 | A1 | 6/2005 | Milosavljevic | |
| 2005/0275594 | A1 | 12/2005 | Zhang | |
| 2006/0019730 | A1 | 1/2006 | Kim | |
| 2006/0284773 | A1 | 12/2006 | Park et al. | |
| 2007/0109208 | A1 | 5/2007 | Turner | |

FOREIGN PATENT DOCUMENTS

| | | | |
|---|---|---|---|
| DE | 20306921 | U1 | 9/2003 |
| DE | 10257556 | B3 | 9/2004 |
| EP | 0590671 | | 12/1997 |
| EP | 0892459 | A1 | 1/1999 |
| EP | 1198027 | A1 | 4/2002 |
| EP | 1469549 | A1 | 10/2004 |
| EP | 1544954 | A2 | 6/2005 |
| EP | 1610411 | A1 | 12/2005 |
| EP | 1657785 | | 5/2006 |
| GB | 2389246 | | 3/2003 |
| GB | 2389246 | A1 | 12/2003 |
| JP | 2003-229709 | | 8/2003 |
| JP | 2005-167960 | | 6/2005 |
| WO | 9903169 | A1 | 1/1999 |
| WO | 0133663 | A1 | 5/2001 |
| WO | 0161781 | A1 | 8/2001 |
| WO | WO-0161781 | | 8/2001 |
| WO | 0227859 | A1 | 4/2002 |
| WO | WO-0227859 | | 4/2002 |
| WO | 02078123 | A1 | 10/2002 |
| WO | WO-02/078123 | | 10/2002 |
| WO | 03041216 | A2 | 5/2003 |
| WO | 2004049501 | A1 | 6/2004 |
| WO | 2004054034 | A1 | 6/2004 |
| WO | 2005020371 | A1 | 3/2005 |
| WO | WO-2005020371 | | 3/2005 |
| WO | 2005031914 | A2 | 4/2005 |

OTHER PUBLICATIONS

Long , S. A. Rebuttal expert report of Dr. Stuart A. Long (redacted version). Fractus. Feb. 16, 2011.

Jaggard , D. L. Expert report of Dwight L. Jaggard (redacted)—expert witness retained by Fractus. Fractus. Feb. 23, 2011.

Fredj., Aziz., "International Search Report" for PCT/EP2006/061564 as completed Sep. 26, 2007, (4 pages).

Karkkainen, M. K., Meandered multiband PIFA with coplanar parasitics patches, IEEE Microwave and Wireless Components Letters, Oct. 2005, vol. 15, No. 10.

* cited by examiner (a)

(b)

(a)

(b)

ANTENNA CONTACTING ASSEMBLY

CROSS-REFERENCE TO RELATED APPLICATIONS

This patent application claims the benefit of priority from U.S. Provisional Patent Application No. 60/678,571 filed May 6, 2005.

BACKGROUND

A typical internal antenna for wireless devices, like for example cell phones, consists of a conductive plate or wire usually mounted on a plastic carrier that provides mechanical support. The antenna is assembled in the wireless device, forming an integral part of such a device. The wireless device will usually have a multilayer printed circuit board (PCB) on which it carries the electronics.

In order to feed the antenna, an electrical path must exist to connect the antenna to the Radio Frequency (RF) front-end of the circuit, or the RF input/output of an electronic device, on the PCB. Said electrical path is created through contact means which ensure the electrical connection of the antenna to the RF front-end of the circuit.

A typical way to feed the antenna is by means of a spring contact. The spring contact ensures good electrical continuity of the signal from the RF signal tracks on the PCB to the antenna, which is achieved by tensional strength of the lever of the spring contact on the appropriate pad or contact region on the PCB.

Furthermore, the spring contact has also the mechanical function of providing robustness of the assembly in front of tolerance errors in the height of the antenna over the PCB when the piece that contains the antenna is fixed onto the PCB, for example by means of clips, screws or adhesives.

FIG. 2 shows a typical prior-art compression spring contact.

As shown in FIG. 2, the interference of the tip 22*c* of the spring contact 22 with the second conducting surface 21 (typically a PCB) translates the vertical displacement necessary to achieve a given tensional strength on the pad of the second conducting surface 21, into horizontal displacement 26 on the plane of the second conducting surface 21. The behavior of the spring contact 22 is such that when compression is applied to the spring contact 22 the entire spring lever 22*b* reacts mainly as if it rotated with respect to the center of curvature of the first bent 23 of the spring contact 22 after departing from the first conducting surface 20 (typically an antenna element) to a new position 25. Since the center of curvature of this bent 23 is closer to the first conducting surface 20 than to the second conducting surface 21, and hence far from the tip 22*c* of the spring contact 22, even a rotation by a small angular amount of the lever 22*b* of the spring contact 22 results in significant linear displacement 26 on the plane of the second conducting surface 21. This implies that the pad on the second conducting surface that accepts the tip 22*c* of the spring lever 22*b* has to be long enough in the direction of the displacement of the spring contact 22 in order to ensure that the tip 22*c* of the spring contact 22 lands on the pad, and thus good electrical contact is obtained.

The extra space necessary for the pad that accepts the spring contact becomes a serious overhead when the size of the PCB of the wireless device is particularly small (as for example those in slide-type or clamshell-type cell phones), and/or high density of components is needed to host the electronics and other elements like for instance integrated circuits, batteries, handset-cameras and speakers, LCD screens, or vibrators.

There exists one state of the art solution that attempts to solve this problem, and that is the use of a POGO pin. A POGO pin is a component that ensures the electrical connection of the antenna to the RF module of a wireless device featuring a reduced contact area. This type of component has a number of disadvantages. POGO pins are more expensive than conventional compression spring contacts and do still require a certain contact area, which is not always available in PCBs with high density of components. Another disadvantage is that a POGO pin has to be considered as an additional component that has to be taken into account at the early stage of PCB design. That is a serious drawback for antenna designers since the antenna design is often carried out after the design of other parts of the wireless device such as the PCB has been closed.

SUMMARY OF THE INVENTION

The object of the present invention is to provide a new antenna contacting assembly, an antenna system provided with such antenna contacting assembly and a wireless device with an antenna system provided with such antenna contacting assembly which allows electrical connection of an antenna element to the RF module such as the RF front-end of a circuit or the RF input/output in a wireless device when very little space is available on the side of the PCB underneath the antenna element.

This problem is solved with the antenna contacting assembly of claim 1, the antenna system of claims 11, 12 and/or 13 and the wireless device of claims 18, 19 and/or 20.

The antenna contacting assembly provides electrical contact between a first conducting surface and a second conducting surface by engaging in traction mode said first conducting surface with said second conducting surface.

Said first surface may include at least a radiating element and said second conducting surface may be e.g. a conductive layer of a printed circuit board of a wireless device. Said printed circuit board, from now on PCB, may be a multilayer board (with multiple conductive layers separated by insulating layers) arranged in such a way that the outer layer is the ground plane layer, therefore shielding inner layers. Said ground plane may be arranged as an outer layer in either one or both sides of said PCB. The ground plane layer may also be provided as an inner layer of a multilayer PCB.

The contacting assembly such as a contact switch or a spring contact comprises a first portion that may be attached to, connected to or form part of said first conducting surface, typically a radiating antenna element, and a second portion for providing electrical contact between said first and second conducting surfaces.

Said second portion may be shaped or bent so that it is substantially curved back towards the inner part of said first conducting surface. Said second portion may comprise a tip for contacting on said second conducting surface. This way the second conducting surface is placed in the inner part of the curve defined by the contacting assembly, and lies between the first conducting surface and the tip of said second portion.

The contacting assembly may be a spring contact or the like and may be provided with a spring lever and a spring tip.

The radiating antenna element of the antenna device is built on said first surface, and it is mechanically spaced away from the printed circuit board by means of for instance a plastic carrier or a dielectric support. This way, the PCB applies pressure at the tip of the second portion of said contacting assembly, which then operates in a traction mode rather than in a compression mode.

Said antenna contacting assembly can absorb the change in height necessary to achieve a given tensional strength with reduced transversal displacement and in which the contact between the tip of the second portion of said contacting assembly and the second conducting surface is made.

The antenna contacting assembly of the present invention provides electrical contact between a radiating antenna element and a PCB in a densely populated PCB. Under those circumstances the only way to integrate such components may be to allocate the pads or contacts on the opposite side of the PCB, instead of the usual practice of allocating them on the closer surface underneath the antenna device.

The antenna system of the present invention comprises an antenna contacting assembly as described above. Said antenna system comprises a ground plane and at least one radiating antenna element electrically connected to said ground plane through the contacting assembly of the present invention. The radiating antenna element may be as well electrically connected to the RF module of a wireless device through at least one contacting assembly according to the present invention.

The present invention can be applied to antenna systems comprising internal antenna elements with different antenna topologies, both balanced and unbalanced. In particular, monopoles, dipoles, loops, folded and loaded monopoles and dipoles, and their slot or aperture equivalents (slot monopoles, slot dipoles, slot loops, folded and loaded slot monopoles and dipoles) are some of the structures in which the present invention can be applied. Other structures include shorted and bent monopoles (L monopoles, IFA), multi-branch structures, coupled monopoles and dipole antennas and again their aperture equivalents. Another possible antenna configuration is a microstrip or patch antenna, including their shorted versions (shorted patches and planar inverted F or PIFA structures All of these antennas could use an antenna contacting assembly according to the present invention to connect said antenna element to the pad or electrical contact region on the PCB.

In some cases the antenna system will be formed by an active radiating antenna element (i.e., a radiating element electrically fed either by direct contact, or capacitive or inductive coupling), and one or more parasitic antenna elements that are capacitively or inductively coupled with the active element. The parasitic element of the antenna can be connected to the RF ground plane of the PCB of the wireless device by means of the antenna contacting assembly of the present invention.

In such an antenna system in general one or more contacting assemblies such as a spring contact can be provided. For instance in an antenna system featuring a planar inverted F antenna element a pair of spring contacts may be provided so that the antenna element can be connected to feeding and ground connections of said antenna system.

One aspect of the invention relates to the technique to shape the second portion of an antenna contacting assembly to result in little horizontal displacement on the PCB and allow higher integration of components.

As in a conventional spring contact, the tensional strength exerted by the tip of the antenna contacting assembly on the pad or contact region of the PCB can be controlled by shaping appropriately the metallic second portion of the antenna contacting assembly, such as a metallic lever. However, unlike conventional spring contacts in which the interference of the lever with the PCB results in compression of the spring, the particular shape of the antenna contacting assembly here disclosed makes the spring extend when the lever interferes with the PCB.

A further difference between the present antenna contacting assembly with respect to the spring contacts found in the prior-art is that the landing region of the tip of the second portion is on the inside of said second portion (i.e. the lever), rather than on the outside as it happens in conventional spring contacts.

The reduced transversal displacement of the antenna contacting assembly means that the pad or contact region on the PCB can be made significantly smaller, which means more repeatability in the electrical parameters of the antenna when mounting and testing the antenna in the wireless device. Moreover, a smaller contact region will lead to less parasitic capacitive effects that can affect the performance of the antenna.

Another aspect of the invention relates to the technique to shape the antenna contacting assembly in a way that the tip of the antenna contacting assembly lands on the reverse side of the PCB, allowing for a higher integration of components on the top side of the PCB, and in particular underneath the antenna.

This aspect can be also advantageously used to facilitate the testing of the RF electronics of the wireless device, as in some cases space constrains might not make it easy to probe the pad on the PCB that is used to feed the antenna if this is on the same side as the antenna. Having the feeding pad on the reverse side of the PCB can solve the problem of testing the RF electronics of the device either when developing the device, or during the production phase.

The wireless device of the present invention comprises at least an antenna contacting assembly as described above. The wireless device of the present invention may comprise one or more antenna system as also described here before. Said wireless device comprises a PCB featuring a ground plane, further comprising an RF module, one or more radiating antenna elements electrically connected to said ground plane. Said antenna element may be also connected to said RF module through at least another more contacting assembly according to the present invention. The contacting assembly may be a spring contact or the like and may be provided with a spring lever and a spring tip.

The present invention can be arranged inside several kinds of wireless devices such as a cellular phone, a mobile phone, a handheld phone, a smart phone, a satellite phone, a multimedia terminal, personal digital assistant (PDA), a portable music player, a radio, a digital camera, a USB dongle, a wireless headset, a hands-free kit, an electronic game, a headset, an MP3 player, a portable DVD/CD player, a Mini-PCI, a Notebook, PC with WiFi module integrated, or a pocket PC with integrated Wi-Fi.

In some preferred embodiments the wireless device is operating at one, two, three or more of the following communication and connectivity services: Bluetooth, 2.4 GHz Bluetooth, 2.4 GHz WiMAX, ZigBee, ZigBee at 860 MHz, ZigBee at 915 MHz, GPS, GPS at 1.575 GHz, GPS at 1.227 GHz, Galileo, GSM 450, GSM 850, GSM 900, GSM 1800, DCS-1800, UMTS, CDMA, DBA, WLAN, WLAN at 2.4 GHz-6 GHz, PCS 1900, KPCS, WCDMA, SDARs, XDARS, DAB, WiFi, UWB, 2.4-2.483 GHz band, and 2.471-2.497 GHz band.

Generally, the present invention can be arranged to facilitate the integration of the antenna system in a way that it is compatible with high density of components on the PCB of a wireless device. For miniaturization purposes, at least a portion of the curve defining the conducting trace, conducting wire or contour of the conducting sheet of the antenna with a contacting assembly as described above will preferably be a space-filling curve, a box-counting, a grid-dimension curve, or a fractal based curve. The conducting trace, conducting wire or contour of the conducting sheet of the antenna might take the form of a single curve, or might branch-out in two or more curves, which at the same time in some embodiments will be also of the space-filling, box-counting, grid-dimension, or fractal kinds. Additionally, in some embodiments a part of the curve will be coupled either through direct contact or electromagnetic coupling to a conducting polygonal or multilevel surface.

The present invention also provides an advantage for those wireless devices that feature a slim form factor. While usually a conventional internal antenna for a cellular phone features a distance of 5 to 7 mm to the PCB, there is a current trend to reduce such a distance below 4 mm, for instance below 3 or 2 mm. In such cases it is not convenient due to mechanical, reliability or cost reasons to implement a conventional compression spring contact. In those cases, a slim device can benefit of the slim profile of an internal antenna with an antenna contacting assembly according to the present invention.

With the following embodiments a number of advantages can be achieved as described below:

EMBODIMENT 1

In a preferred embodiment it can be advantageous for electrical and/or mechanical reasons not to have the antenna contacting assembly on the perimeter of the PCB of the wireless device, or to have extra flexibility in the placement of the antenna contacting assembly. In this particular case, an aperture may be created on the PCB of the wireless device to allow the antenna contacting assembly to go through the PCB and thereby having the tip of the second portion land on the appropriate pad or contact region located on the reverse side of the PCB.

EMBODIMENT 2

In another preferred embodiment the antenna element includes two or more antenna contacting assemblies. Preferably, at least one of the antenna contacting assemblies will be used to feed the antenna element, while preferably, one or more of the antenna contacting assemblies will be used to short-circuit the antenna to the RF ground plane of the PCB in order to adjust the electrical parameters of the antenna. In some embodiments the antenna including two or more antenna contacting assemblies will have some of the antenna contacting assemblies landing on the reverse side of the PCB (preferably, but not necessarily, the feeding contact for ease in testing), while other antenna contacting assemblies landing on the top side of the PCB. Such an embodiment offers more flexibility in the design of an antenna system and the design of a wireless device in which the antenna system is to be integrated. Since the shaping of each antenna contacting assembly is done independently, having some landing on the top side and other on the reverse side of the PCB does not increase the fabrication complexity of an antenna system.

EMBODIMENT 3

In another embodiment the antenna system with its antenna contacting assembly is not necessarily placed on the top edge of the PCB, but may instead be placed at either the longer side edges or the inner part of the PCB.

EMBODIMENT 4

In yet another embodiment there is no RF ground plane located in the totality of the projection of the antenna element footprint on the PCB. By antenna element projection it is meant the lower or upper projection of the antenna element on the PCB, being lower projection what is normally understood by the expression underneath the antenna. This can be achieved in several ways, for instance by removing at least one of the ground layers on the PCB, by displacing partially or totally the antenna outside the area of the PCB, or for instance by mounting the antenna element in a orthogonal or generally non parallel arrangement with respect to the PCB. In the later case the cover or case of the device or an adhoc plastic or dielectric carrier can be generally used, without any limiting purpose, to control the relative mechanical position of the antenna with respect to the PCB.

EMBODIMENT 5

Having the pad or contact regions of the antenna contacting assembly on the reverse side of the PCB is advantageously used to increase the electrical height of a patch antenna or planar inverted-F antenna (PIFA) over the ground plane layer. In this case the ground plane is located as close as possible to the bottom surface of a multilayer PCB. Proceeding in this manner, the electrical performance of the antenna (bandwidth, efficiency, gain) is enhanced.

The attached drawings comprise the following figures:

FIG. 1*a* is a side perspective view and FIG. 1*b* is a bottom perspective view, of said assembly;

Figure 1:
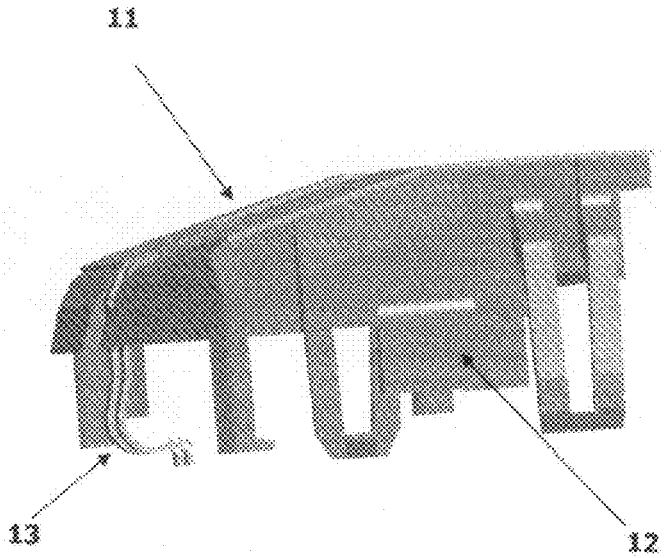
FIG. 1 shows an antenna system comprising an antenna contacting assembly as described in this patent application.
Figure 1:
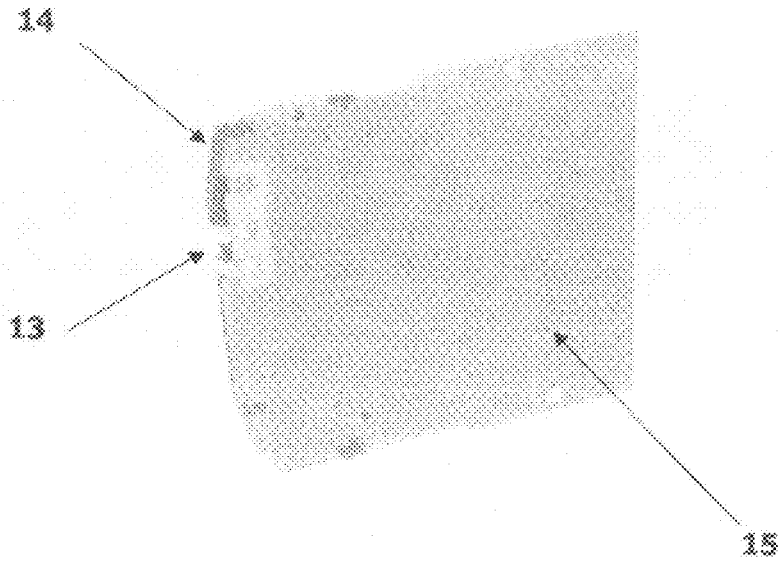

FIG. 1(*a*) shows a planar inverted-F antenna element 11 composed of a metal sheet on a plastic carrier 12 that has two antenna contacting assemblies 13 as claimed in this patent application. FIG. 1(*b*) shows the bottom 15 view of a PCB in which it can be observed the contact of the antenna contacting assemblies 13 as described on their corresponding pads of the PCB. The antenna element is mounted on the other side of the PCB and thus not visible in the figure.

Figure 2:
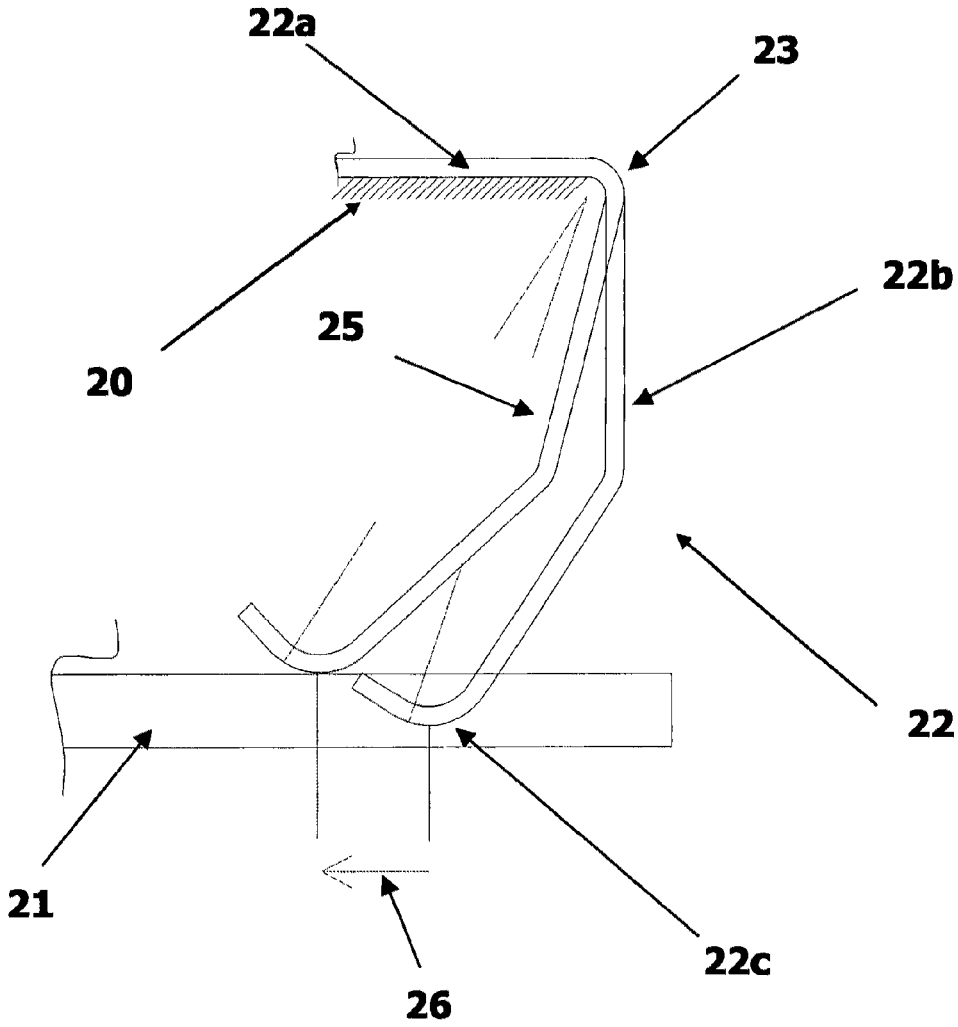
Fig. 2 (PRIOR ART)
FIG. 2 shows a typical prior-art compression spring contact.

FIG. 2 shows how the interference of the tip 22*c* of the spring contact 22 with the second conducting surface 21 (typically a PCB) translates the vertical displacement necessary to achieve a given tensional strength on the pad of the second conducting surface 21, into horizontal displacement 26 on the plane of the second conducting surface 21. The behavior of the spring contact 22 is such that when compression is applied to the spring contact 22 the entire spring lever 22*b* reacts mainly as if it rotated with respect to the center of curvature of the first bent 23 of the spring contact 22 after departing from the first conducting surface 20 (typically an antenna element) to a new position 25. Since the center of curvature of this bent 23 is closer to the first conducting surface 20 than to the second conducting surface 21, and hence far from the tip 22*c* of the spring contact 22, even a rotation by a small angular amount of the lever 22*b* of the spring contact 22 results in significant linear displacement 26 on the plane of the second conducting surface 21. This implies that the pad on the second conducting surface that accepts the tip 22*c* of the spring lever 22*b* has to be long enough in the direction of the displacement of the spring contact 22 in order to ensure that the tip 22*c* of the spring contact 22 lands on the pad or contact region, and thus good electrical contact is obtained.

Figure 3:
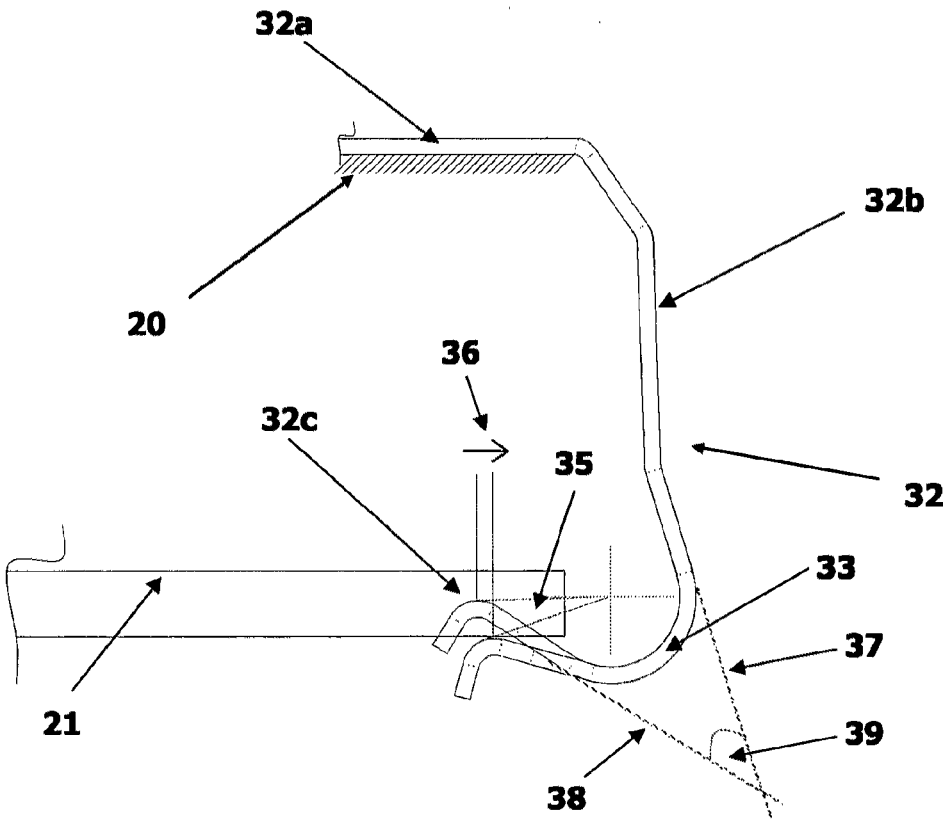
FIG. 3 shows the principle of operation of an antenna contacting assembly according to the invention.

FIG. 3. shows the horizontal displacement 36 of an antenna contacting assembly 32 when it interferes with the PCB 21 is greatly reduced. Because of its particular shape, when traction is applied to the antenna contacting assembly 32, it behaves as if mainly just the straight segment of the second portion 32*b* of the antenna contacting assembly 32, that is the segment before its tip 32*c* rotates with respect to the center of curvature of the curved portion 33 that substantially bends the shape of the second portion 32*b* back towards the inner part of the surface of the antenna element 20. The angle that this said curved portion 33 forms is as shown in FIG. 3 smaller than 90 degrees. Said angle is defined by the line 37 tangent to the curved portion 33 at its starting point and the line 38 tangent to the curved portion 33 at its end point and includes the point of the center of curvature of the curved portion 33.

Since the center of curvature of this bent 33 is closer to the second surface 21 than to the first conducting surface 20, and hence close to the tip 32*c* of the second portion 32*b* of the antenna contacting assembly 32, a rotation 35 by an angular amount is not significantly magnified when converted into a linear displacement 36 on the plane of the second conducting surface 21. This implies a much smaller longitudinal displacement 36 of the tip 32*c* of the second portion 32*b* than for a prior-art spring contact 22 for the same tensional strength and contact interference. Therefore, the size of the pad or contact region on the PCB on which the tip 32*c* of the antenna contacting assembly 32 lands can be made significantly smaller.

Figure 4:
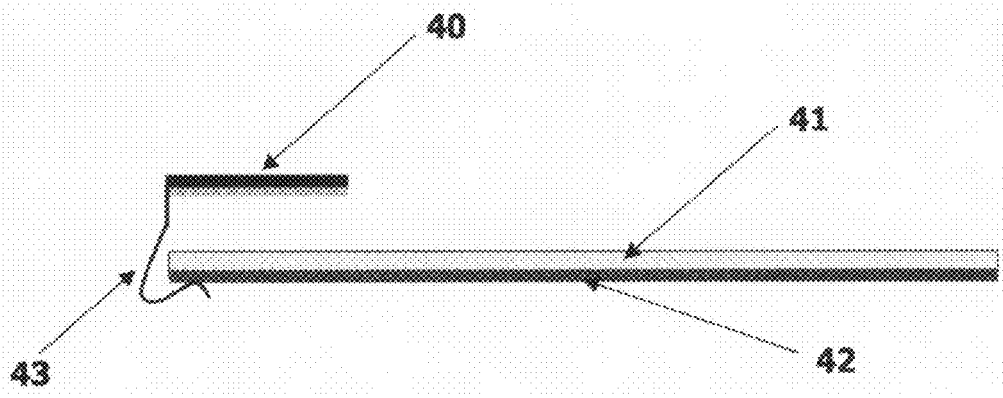
FIG. 4 to FIG. 9 show different configurations of antenna systems comprising antenna contacting assemblies according to the present invention.

FIG. 4 shows a patch antenna element or PIFA 40 mounted on a PCB 41, 42 and using an antenna contacting assembly 43 according to the present invention.

Figure 5:
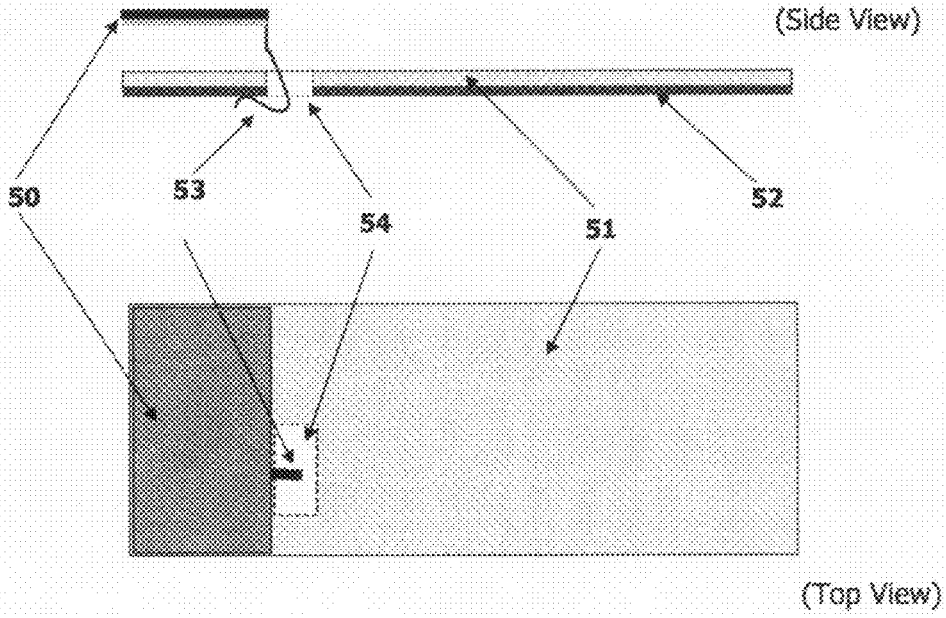

FIG. 5 shows an antenna element 50 mounted on a PCB 51,52 of a wireless device that uses the antenna contacting assembly 53 of the present invention, in which the antenna contacting assembly 53 goes through the PCB 51, 52 by means of an aperture 54 on the PCB.

Figure 6:
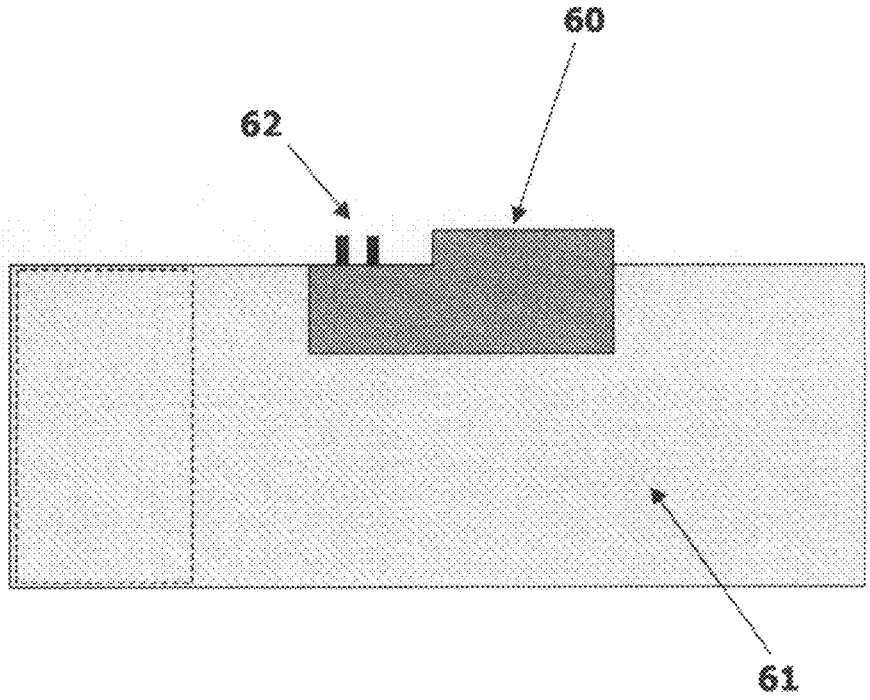

FIG. 6 shows an antenna element 60, which uses two antenna contacting assemblies 62 as described in this patent application, and that has been placed on one of the longer sides of the PCB 61.

Figure 7:
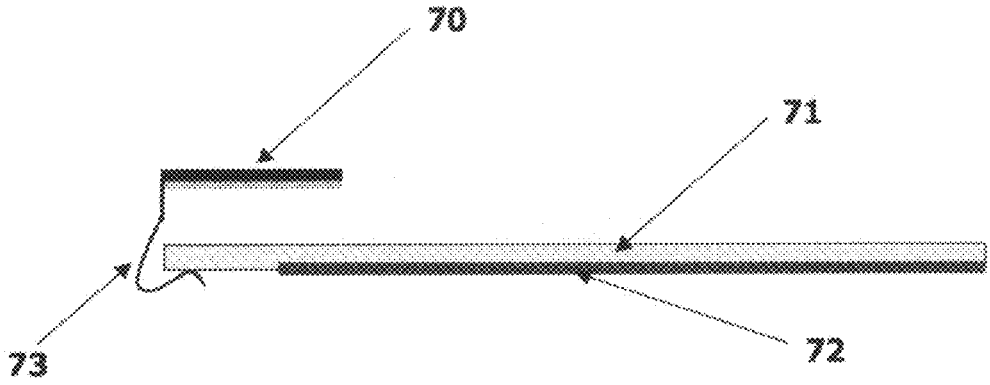

FIG. 7 shows a monopole or inverted-F antenna element 70 that uses the antenna contacting assembly 73 of the present invention. As depicted, in this case the ground plane 72 on the PCB 71 does not cover the totality of the projection of the antenna element 70.

Figure 8:
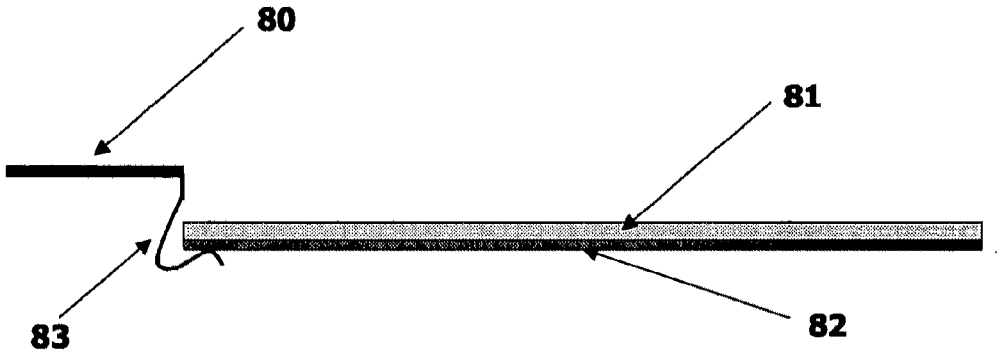

FIG. 8 shows a monopole antenna or inverted-F antenna element 80 that uses the antenna contacting assembly 83 of the present invention. In this case the antenna element 80 is mounted in such a way in the wireless device that neither the ground plane 82 (understood as a layer on the PCB 81) nor the PCB 81 is in the projection of the antenna element 80.

Figure 9:
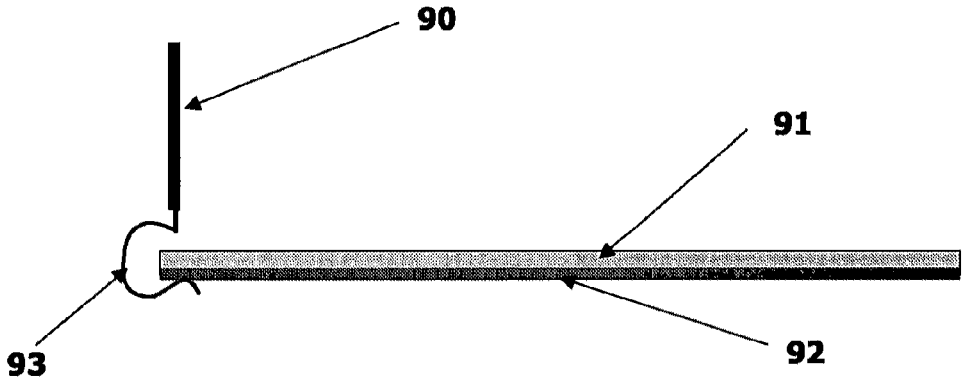

FIG. 9 shows an antenna element 90 that uses the antenna contacting assembly 93 with reduced horizontal displacement according to the invention, and that it is mounted on a PCB 91 in such a way that the metal sheet or wire of the antenna element 90 is substantially perpendicular to the ground plane 92 and/or the PCB 91.

Figure 10:
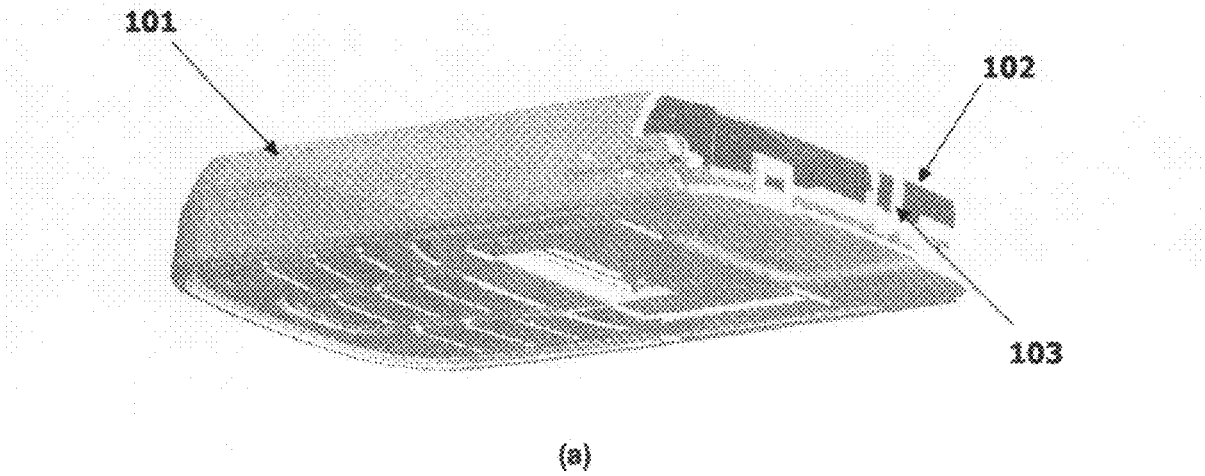
FIG. 10 shows a wireless device with an antenna system provided with two antenna contacting assemblies.
Figure 10:
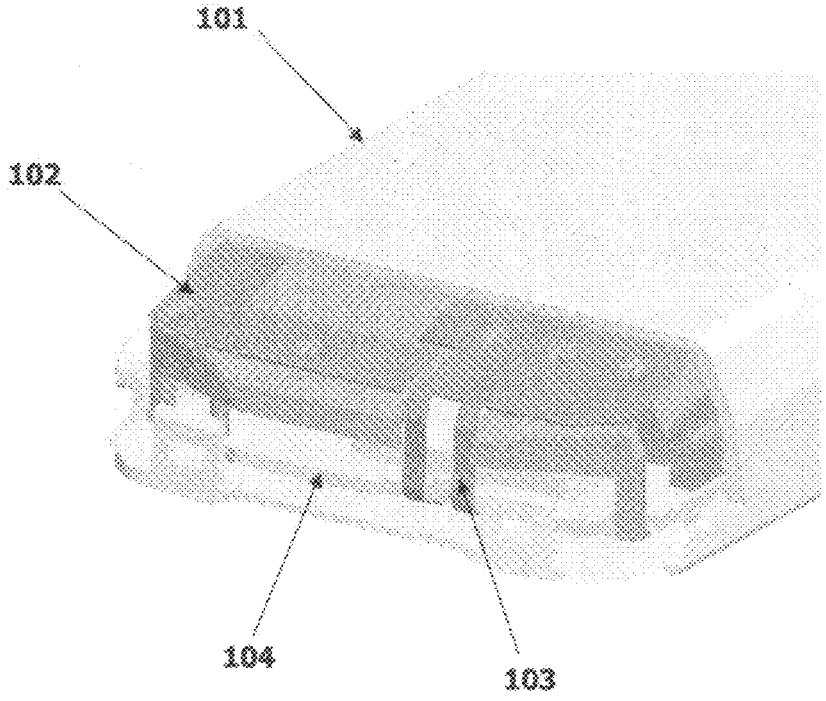

FIG. 10 shows a wireless device 101 (in the figure a handset telephone for mobile communications) that integrates an internal antenna element 102 that uses antenna contacting assemblies 103, to connect the antenna element 102 to the accepting pads on the PCB 104. FIG. 10 (*a*) shows a general view of the handset and FIG. 10 (*b*) a detailed view of the handset near the region in which the antenna contacting assemblies 103 of the antenna element 102 make electrical contact on the PCB.

Space Filling Curves

In some examples, the antenna system comprising an antenna contacting assembly may be miniaturized by shaping at least a portion of the conducting trace, conducting wire or contour of a conducting sheet of the radiating antenna element (e.g., a part of the arms of a dipole, the perimeter of the patch of a patch antenna, the slot in a slot antenna, the loop perimeter in a loop antenna, or other portions of the antenna) as a space-filling curve (SFC).

A SFC is a curve that is large in terms of physical length but small in terms of the area in which the curve can be included. More precisely, for the purposes of this patent document, a SFC is defined as follows: a curve having at least five segments that are connected in such a way that each segment forms an angle with any adjacent segments, such that no pair of adjacent segments define a larger straight segment. In addition, a SFC does not intersect with itself at any point except possibly the initial and final point (that is, the whole curve can be arranged as a closed curve or loop, but none of the lesser parts of the curve form a closed curve or loop).

A space-filling curve can be fitted over a flat or curved surface, and due to the angles between segments, the physical length of the curve is larger than that of any straight line that can be fitted in the same area (surface) as the space-filling curve. Additionally, to shape the structure of a miniature antenna, the segments of the SFCs should be shorter than at least one fifth of the free-space operating wavelength, and possibly shorter than one tenth of the free-space operating wavelength. The space-filling curve should include at least five segments in order to provide some antenna size reduction, however a larger number of segments may be used. In general, the larger the number of segments and the narrower the angles between them, the smaller the size of the final antenna.

Box-Counting Curves

In other examples, the antenna system comprising an antenna contacting assembly may be miniaturized by shaping at least a portion of the conducting trace, conducting wire or contour of a conducting sheet of the antenna to have a selected box-counting dimension.

For a given geometry lying on a surface, the box-counting dimension is computed as follows. First, a grid with substantially squared identical cells boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of the antenna system comprising an antenna contacting assembly described herein, the box-counting dimension may be computed by placing the first and second grids inside a minimum rectangular area enclosing the conducting trace, conducting wire or contour of a conducting sheet of the antenna and applying the above algorithm. The first grid should be chosen such that the rectangular area is meshed in an array of at least 5×5 boxes or cells, and the second grid should be chosen such that L2=½ L and such that the second grid includes at least 10×10 boxes. The minimum rectangular area is an area in which there is not an entire row or column on the perimeter of the grid that does not contain any piece of the curve.

The desired box-counting dimension for the curve may be selected to achieve a desired amount of miniaturization. The box-counting dimension should be larger than 1.1 in order to achieve some antenna size reduction. If a larger degree of miniaturization is desired, then a larger box-counting dimension may be selected, such as a box-counting dimension ranging from 1.5 to 3. For the purposes of this patent document, curves in which at least a portion of the geometry of the curve has a box-counting dimension larger than 1.1 are referred to as box-counting curves.

For very small antennas, for example antennas that fit within a rectangle having maximum size equal to one-twentieth the longest free-space operating wavelength of the antenna, the box-counting dimension may be computed using a finer grid. In such a case, the first grid may include a mesh of 10×10 equal cells, and the second grid may include a mesh of 20×20 equal cells. The box-counting dimension (D) may then be calculated using the above equation.

In general, for a given resonant frequency of the antenna, the larger the box-counting dimension, the higher the degree of miniaturization that will be achieved by the antenna. One way to enhance the miniaturization capabilities of the antenna is to arrange the several segments of the curve of the antenna pattern in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid.

Figure 11:
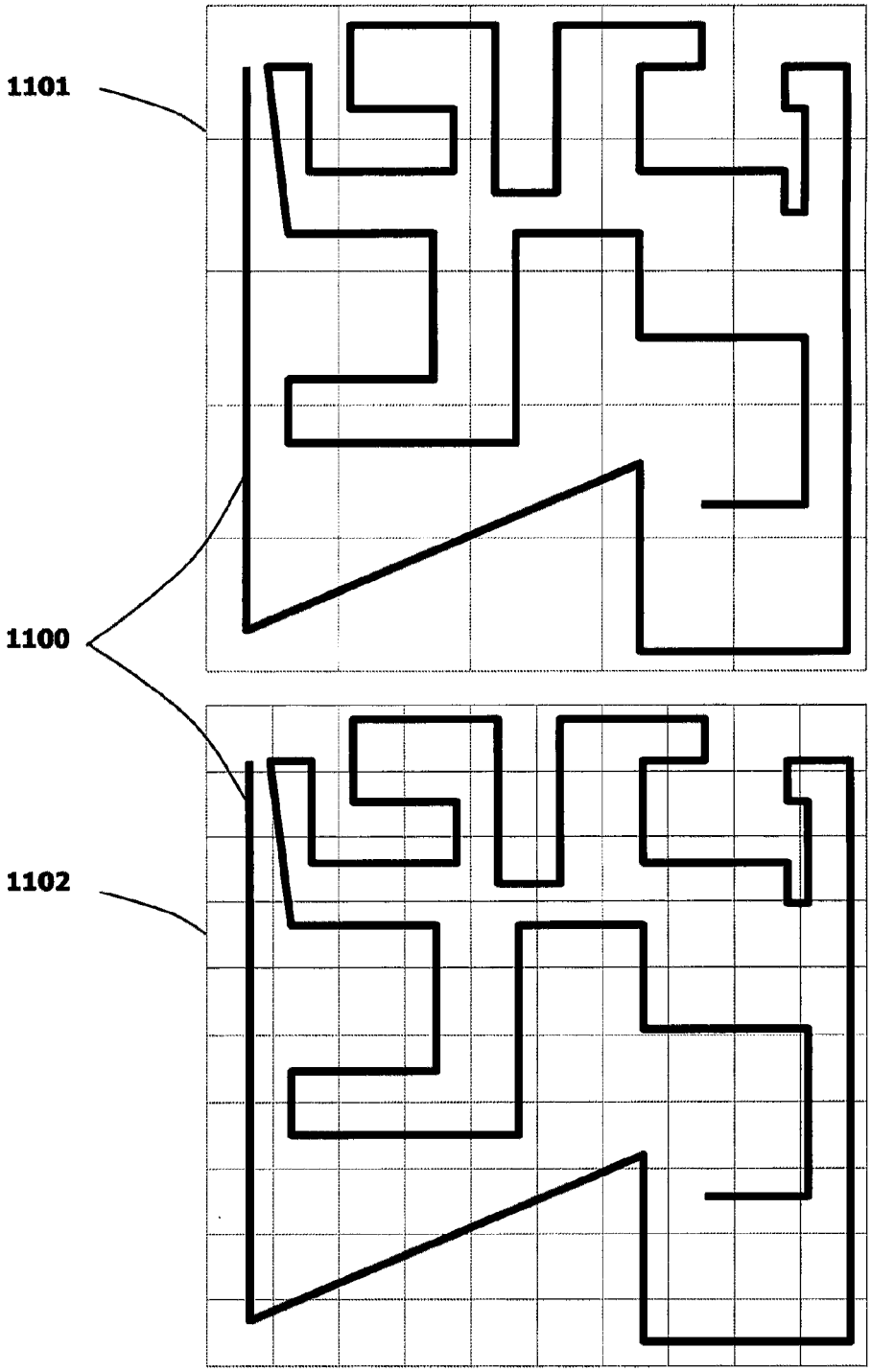
FIG. 11 shows an example of a box counting curve located in a first grid of 5×5 boxes and in a second grid of 10×10 boxes.
Figure 12:
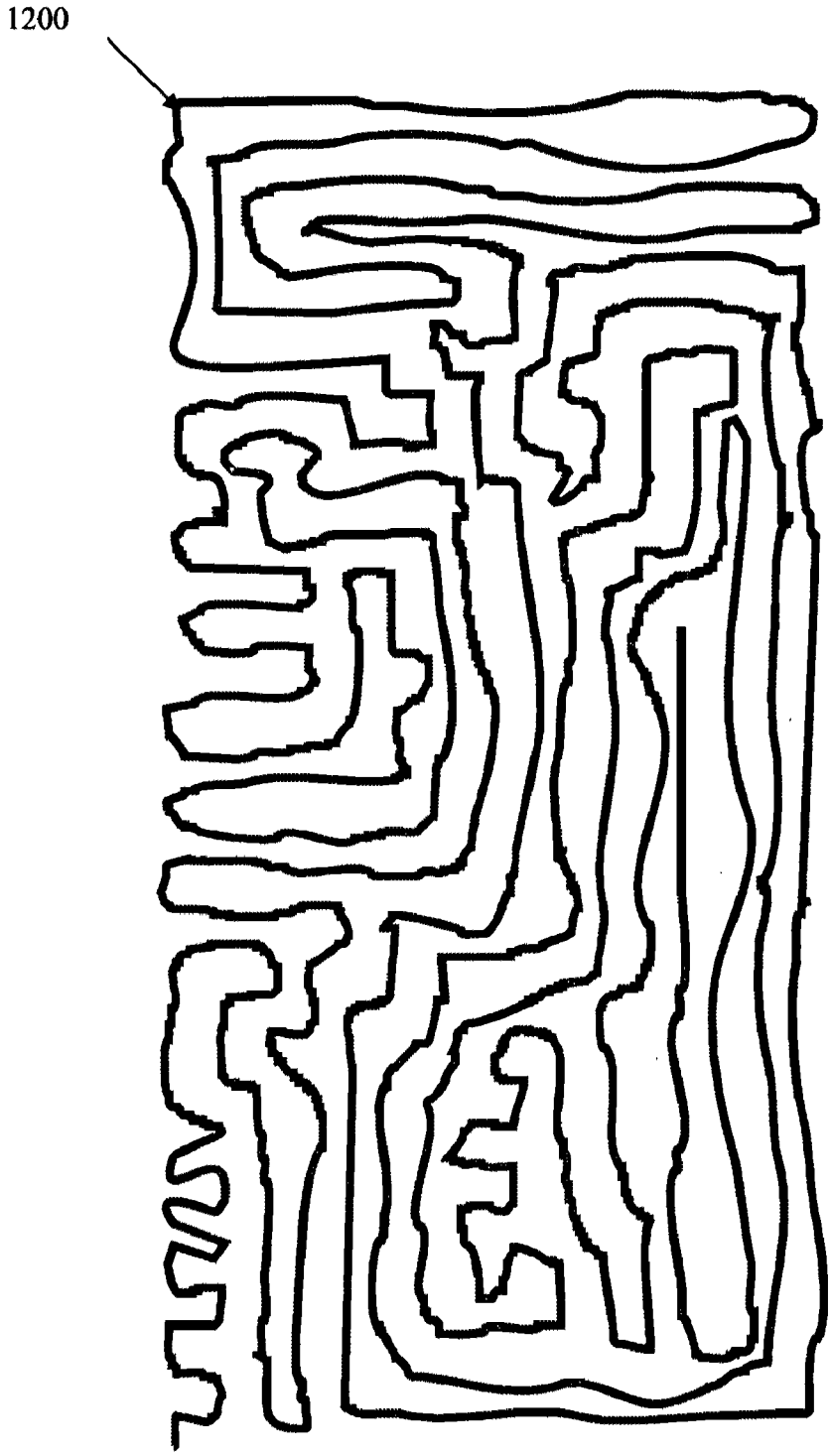
FIG. 12 shows an example of a grid dimension curve.
Figure 13:
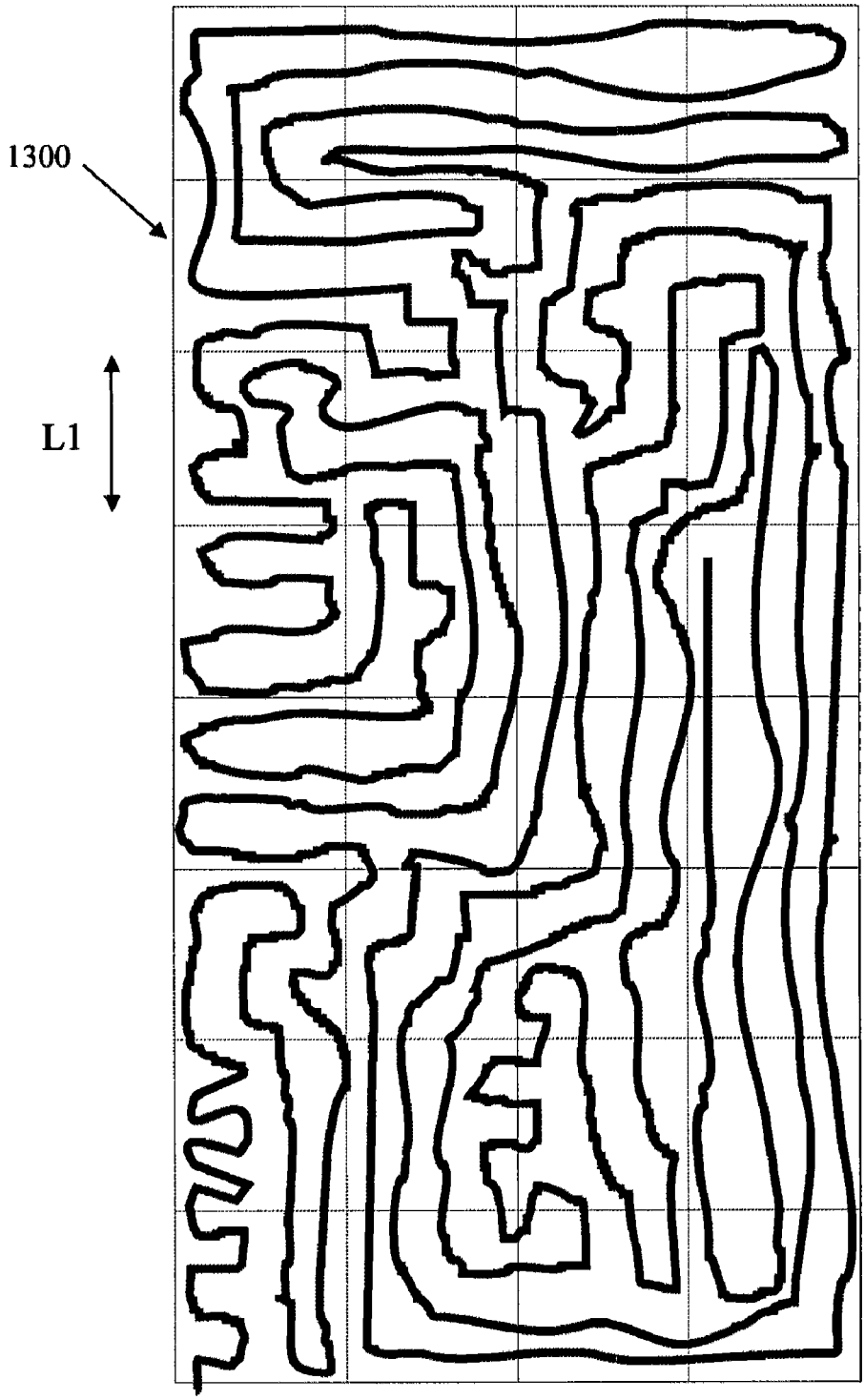
FIG. 13 shows an example of a grid dimension curve located in a first grid.
Figure 14:
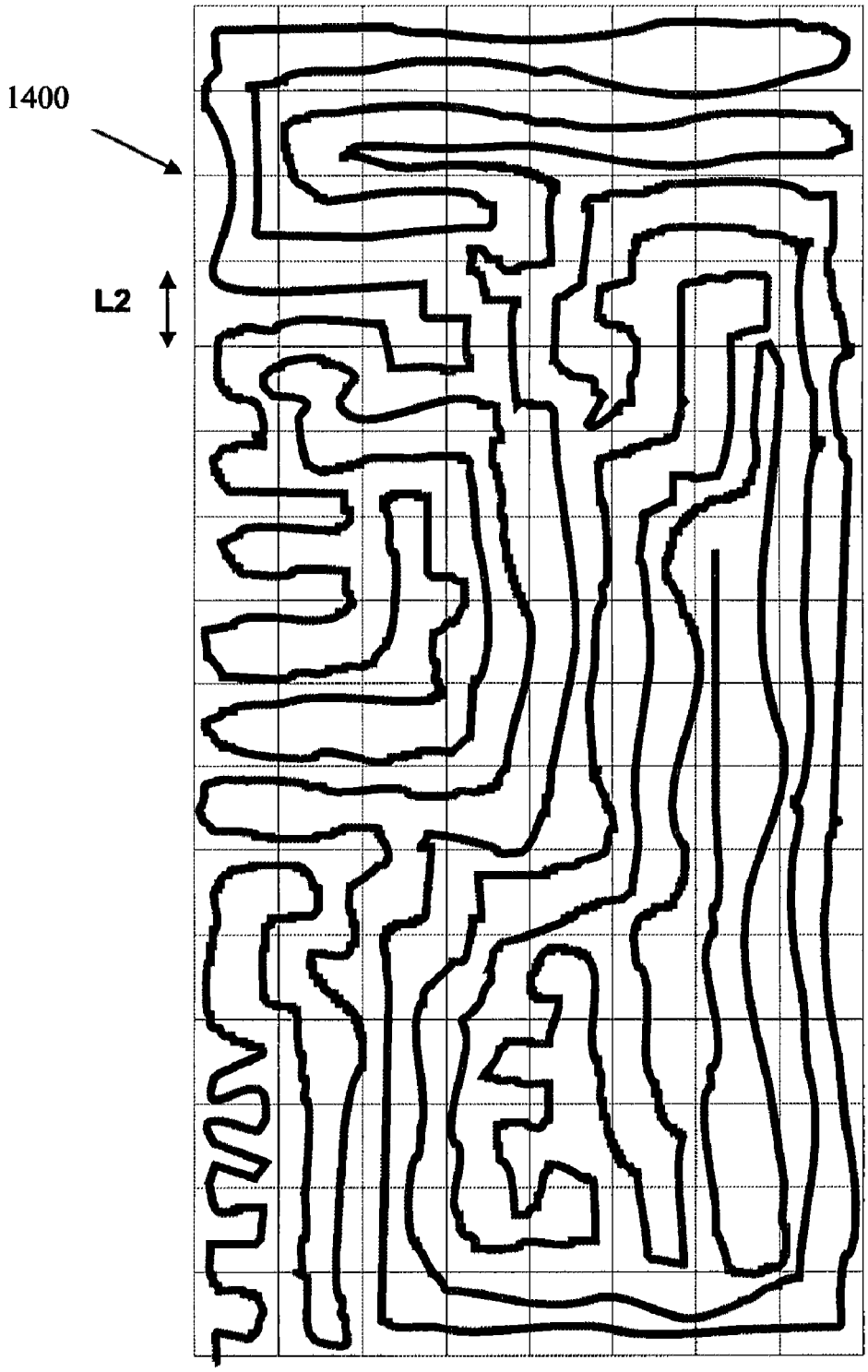
FIG. 14 shows an example of a grid dimension curve located in a second grid.
Figure 15:
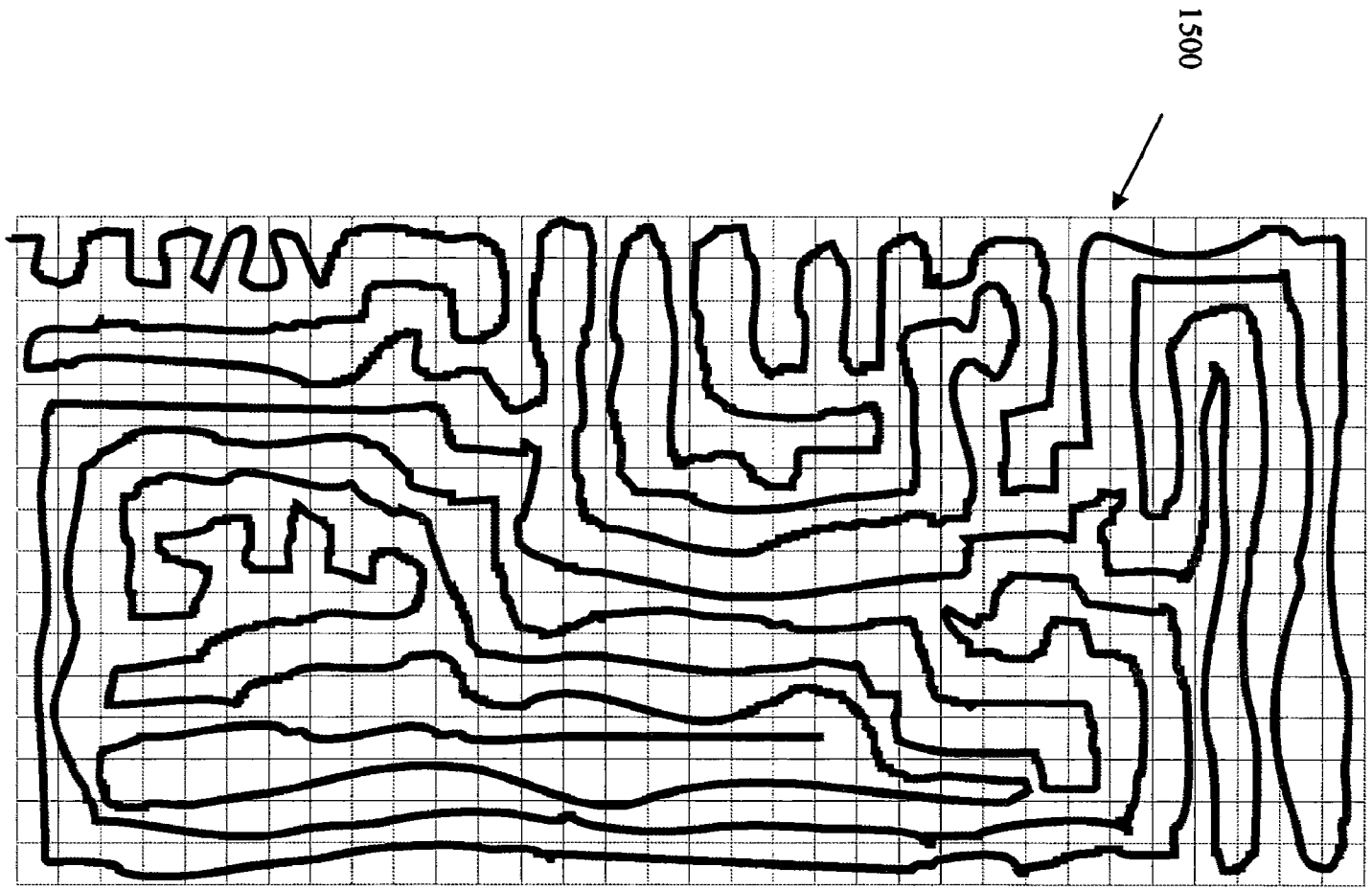
FIG. 15 shows an example of a grid dimension located in a third grid.

FIG. 11 illustrates an example of how the box-counting dimension of a curve (1100) is calculated. The example curve (1100) is placed under a 5×5 grid (1101) and under a 10×10 grid (1102). As illustrated, the curve (1100) touches N1=25 boxes in the 5×5 grid (1101) and touches N2=78 boxes in the 10×10 grid (1102). In this case, the size of the boxes in the 5×5 grid (1101) is twice the size of the boxes in the 10×10 grid (1102). By applying the above equation, the box-counting dimension of the example curve (1100) may be calculated as D=1.6415. In addition, further miniaturization is achieved in this example because the curve (1100) crosses more than 14 of the 25 boxes in grid (1101), and also crosses at least one box twice, that is, at least one box contains two non-adjacent segments of the curve. More specifically, the curve (1100) in the illustrated example crosses twice in 13 boxes out of the 25 boxes.

Grid Dimension Curves

In further examples, the antenna system comprising an antenna contacting assembly may be miniaturized by shaping at least a portion of the conducting trace, conducting wire or contour of a conducting sheet of the antenna to include a grid dimension curve.

For a given geometry lying on a planar or curved surface, the grid dimension of curve may be calculated as follows. First, a grid with substantially identical cells of size L1 is placed over the geometry of the curve, such that the grid completely covers the geometry, and the number of cells N1 that include at least a point of the geometry are counted. Second, a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of the antenna system comprising an antenna contacting assembly described herein, the grid dimension may be calculated by placing the first and second grids inside the minimum rectangular area enclosing the curve of the antenna and applying the above algorithm. The minimum rectangular area is an area in which there is not an entire row or column on the perimeter of the grid that does not contain any piece of the curve.

The first grid may, for example, be chosen such that the rectangular area is meshed in an array of at least 25 substantially equal cells. The second grid may, for example, be chosen such that each cell of the first grid is divided in 4 equal cells, such that the size of the new cells is L2=½L1, and the second grid includes at least 100 cells.

The desired grid dimension for the curve may be selected to achieve a desired amount of miniaturization. The grid dimension should be larger than 1 in order to achieve some antenna size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve having a grid dimension larger than 1 is referred to as a grid dimension curve.

In general, for a given resonant frequency of the antenna, the larger the grid dimension the higher the degree of miniaturization that will be achieved by the antenna. One example way of enhancing the miniaturization capabilities of the antenna is to arrange the several segments of the curve of the antenna pattern in such a way that the curve intersects at least one point of at least 50% of the cells of the first grid with at least 25 cells enclosing the curve. In another example, a high degree of miniaturization may be achieved by arranging the antenna such that the curve crosses at least one of the cells twice within the 25 cell grid, that is, the curve includes two non-adjacent portions inside at least one of the cells or cells of the grid.

Multilevel Structures

In some examples, at least a portion of the conducting trace, conducting wire or conducting sheet of the antenna of the antenna may be coupled, either through direct contact or electromagnetic coupling, to a conducting surface, such as a conducting polygonal or multilevel surface. A multilevel structure is formed by gathering several polygons or polyhedrons of the same type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling these structures to each other electromagnetically, whether by proximity or by direct contact between elements. The majority of the component elements of a multilevel have more than 50% of their perimeter (for polygons) not in contact with any of the other elements of the structure. Thus, the component elements of a multilevel structure may typically be identified and distinguished, presenting at least two levels of detail: that of the overall structure and that of the polygon or polyhedron elements which form it.

Additionally, several multilevel structures may be grouped and coupled electromagnetically to each other to form higher level structures. In a single multilevel structure, all of the component elements are polygons with the same number of sides or are polyhedrons with the same number of faces. However, this characteristic may not be true if several multilevel structures of different natures are grouped and electromagnetically coupled to form meta-structures of a higher level.

A multilevel antenna includes at least two levels of detail in the body of the antenna: that of the overall structure and that of the majority of the elements (polygons or polyhedrons) which make it up. This may be achieved by ensuring that the area of contact or intersection (if it exists) between the majority of the elements forming the antenna is only a fraction of the perimeter or surrounding area of said polygons or polyhedrons.

One example property of a multilevel antennae is that the radioelectric behavior of the antenna can be similar in more than one frequency band. Antenna input parameters (e.g., impedance and radiation pattern) remain similar for several frequency bands (i.e., the antenna has the same level of adaptation or standing wave relationship in each different band), and often the antenna presents almost identical radiation diagrams at different frequencies. The number of frequency bands is proportional to the number of scales or sizes of the polygonal elements or similar sets in which they are grouped contained in the geometry of the main radiating element.

In addition to their multiband behavior, multilevel structure antennae may have a smaller than usual size as compared to other antennae of a simpler structure (such as those consisting of a single polygon or polyhedron). Additionally, the edge-rich and discontinuity-rich structure of a multilevel antenna may enhance the radiation process, relatively increasing the radiation resistance of the antenna and reducing the quality factor Q (i.e., increasing its bandwidth).

A multilevel antenna structure may be used in many antenna configurations, such as dipoles, monopoles, patch or microstrip antennae, coplanar antennae, reflector antennae, wound antennae, antenna arrays, or other antenna configurations. In addition, multilevel antenna structures may be formed using many manufacturing techniques, such as printing on a dielectric substrate by photolithography (printed circuit technique); dieing on metal plate, repulsion on dielectric, or others.

The invention claimed is:

1. An antenna contacting assembly for providing electrical contact between a first conducting surface and a second conducting surface, the antenna contacting assembly comprising:

a first portion solidly attached to said first conducting surface;

a second portion, said second portion shaped for engaging in a traction mode, said first conducting surface with said second conducting surface;

wherein said first and second conducting surfaces include an inner part and an outer part;

wherein said second portion comprises a tip for contacting said outer part of said second conducting surface; and wherein when said tip interferes with said outer part of said second conducting surface for operation of said antenna contacting assembly in said traction mode, said tip rotates and moves away from said first conducting surface.

2. The antenna contacting assembly according to claim 1, wherein said first conducting surface comprises at least a radiating element and said second conducting surface is a conductive layer of a printed circuit board of a wireless device.

3. The antenna contacting assembly according to claim 2, wherein said conductive layer is placed on a reverse side of said printed circuit board.

4. The antenna contacting assembly according to claim 2, wherein said conductive layer comprises at least one radio frequency (RF) module of said wireless device.

5. The antenna contacting assembly according to claim 2, wherein said conductive layer is a ground plane of said wireless device.

6. The antenna contacting assembly according to claim 1, wherein said second portion is substantially curved back towards said first conducting surface and wherein said second conducting surface is placed in an inner part of a curve defined by said second portion.

7. The antenna contacting assembly according to claim 1, wherein said second portion comprises a curved portion, wherein said curved portion forms an angle defined by a line tangent to said curved portion at its starting point and a line tangent to said curved portion at its end point, wherein said angle comprises a center of curvature of said curved portion and is smaller than 180, 145, 90, 80, 70, 60, 50, 40 or 30 degrees.

8. The antenna contacting assembly according to claim 7, wherein said center of curvature of said curved portion is closer to said second conducting surface than to said first conducting surface.

9. The antenna contacting assembly according to claim 1, wherein said outer part of said second conducting surface comprises a contact area.

10. An antenna system comprising at least one antenna contacting assembly according to claim 1.

11. A wireless device comprising at least one antenna contacting assembly according to claim 1.

12. A wireless device comprising:

a printed circuit board (PCB) featuring a ground plane;

a radio frequency (RF) module; and at least one radiating antenna element electrically connected to at least one of said ground plane and said RF module through at least one antenna contacting assembly according to claim 1.

13. The wireless device according to claim 12 comprising an aperture on said PCB to allow said at least one antenna contacting assembly go through the PCB and make electrical contact on a reverse side of said PCB.

14. The wireless device according to claim 12, wherein the wireless device is at least one or a combination of wireless devices of a group of wireless devices comprising a cellular phone, a mobile phone, a handheld phone, a smart phone, a satellite phone, a multimedia terminal, personal digital assistant (PDA), a portable music player, a radio, a digital camera, a USB dongle, a wireless headset, a hands-free kit, an electronic game, a headset, an MP3 player, a portable DVD/CD player, a Mini-PCI, a Notebook, PC with WiFi module integrated, and a pocket PC with integrated Wi-Fi.

15. The wireless device according to claim 12, wherein said device is configured to operate at one or more wireless communication systems preferably selected from the group comprising Bluetooth, 2.4 GHz Bluetooth, 2.4 GHz WiMAX, ZigBee, ZigBee at 860 MHz, ZigBee at 915 MHz, GPS, GPS at 1.575 GHz, GPS at 1.227 GHz, Galileo, GSM 450, GSM 850, GSM 900, GSM 1800, DCS-1800, UMTS, CDMA, DBA, WLAN, WLAN at 2.4 GHz-6 GHz, PCS 1900, KPCS, WCDMA, SDARs, XDARS, DAB, WiFi, UWB, 2.4-2.483 GHz band, and 2.471-2.497 GHz band.

16. The wireless device according to claim 12, wherein said at least one radiating antenna element is placed substantially parallel to said PCB, and wherein a maximum distance between said at least one radiating antenna element and said PCB is below 4, 3 or 2 mm.

17. A wireless device comprising:

a printed circuit board (PCB) featuring a ground plane;

a radio frequency (RF) module; and at least one radiating antenna element electrically connected to at least one of said ground plane and said RF module through at least two antenna contacting assemblies according to claim 1.

18. An antenna system comprising:

a ground plane comprising an inner part and an outer part;

at least one radiating antenna element comprising an inner part and an outer part, wherein the at least one radiating antenna element is electrically connected to said ground plane through at least one antenna contacting assembly;

wherein the at least one antenna contacting assembly comprises:

a first portion solidly attached to said at least one radiating antenna element;

a second portion, wherein said second portion is shaped for engaging in a traction mode, said at least one radiating antenna element with said ground plane;

wherein said second portion comprises a tip for contacting said outer part of said ground plane; and wherein when said tip interferes with said ground plane for operation of said at least one antenna contacting assembly in said traction mode, said tip rotates and moves away from said at least one radiating antenna element.

19. The antenna system of claim 18, wherein:

said at least one radiating antenna element is electrically connected to a radio frequency (RF) module comprised in a conducting surface through at least one additional antenna contacting assembly;

said conducting surface comprises an inner part and an outer part;

said at least one additional antenna contacting assembly comprises a first portion and a second portion;

said first portion of said at least one additional antenna contacting assembly is solidly attached to said at least one radiating antenna element;

said second portion of said at least one additional antenna contacting assembly is shaped for engaging in a traction mode, said at least one radiating antenna element with said conducting surface;

said second portion of said at least one additional antenna contacting assembly comprises a tip for contacting said outer part of said conducting surface; and wherein when said tip interferes with said conducting surface for operation of said at least one additional antenna contacting assembly in said traction mode, said tip rotates and moves away from said at least one radiating antenna element.

20. The antenna system according to claim 18, further comprising:

at least one parasitic element capacitively coupled with the at least one radiating antenna element and electrically connected to said ground plane through at least one additional antenna contacting assembly;

wherein said at least one additional antenna contacting assembly comprises a first portion and a second portion;

wherein said first portion of said at least one additional antenna contacting assembly is solidly attached to said at least one parasitic element;

wherein said second portion of said at least one additional antenna contacting assembly is shaped for engaging in a traction mode, said at least one parasitic element with said ground plane;

wherein said second portion of said at least one additional antenna contacting assembly comprises a tip for contacting said outer part of said ground plane; and wherein when said tip interferes with said ground plane for operation of said at least one additional antenna contacting assembly in said traction mode, said tip rotates and moves away from said at least one parasitic element.

21. The antenna system according to claim 18, further comprising:

at least one parasitic element inductively coupled with the at least one radiating antenna element and electrically connected to said ground plane through at least one additional antenna contacting assembly;

wherein said at least one additional antenna contacting assembly comprises a first portion and a second portion;

wherein said first portion of said at least one additional antenna contacting assembly is solidly attached to said at least one parasitic element;

wherein said second portion of said at least one additional antenna contacting assembly is shaped for engaging in a traction mode said at least one parasitic element with said ground plane;

wherein said second portion of said at least one additional antenna contacting assembly comprises a tip for contacting said outer part of said ground plane; and wherein when said tip interferes with said ground plane for operation of said at least one additional antenna contacting assembly in said traction mode, said tip rotates and moves away from said at least one parasitic element.

22. The antenna system according to claim 18, wherein said at least one radiating antenna element is a monopole, dipole, loop, folded monopole, loaded monopole, folded dipole, loaded dipole, slot monopole, slot dipole, slot loop, folded slot monopole, loaded slot monopole, folded slot dipole, loaded slot dipole, bent monopole, L monopole, IFA, multibranch structure, coupled monopole, aperture, microstrip, patch or planar inverted F antenna element.

23. The antenna system according to claim 18, wherein the at least one radiating antenna element is internal.

24. A wireless device comprising at least one antenna system according to claim 18.

* * * * *